US007503351B2

(12) United States Patent
Hack-Ueberall

(10) Patent No.: US 7,503,351 B2
(45) Date of Patent: Mar. 17, 2009

(54) PAPER MACHINE COVERING

(75) Inventor: Petra Hack-Ueberall, Reutlingen (DE)

(73) Assignee: Voith Patent GmbH, Heidenheim (DE)

( * ) Notice: Subject to any disclaimer, the term of this patent is extended or adjusted under 35 U.S.C. 154(b) by 215 days.

(21) Appl. No.: 11/611,426

(22) Filed: Dec. 15, 2006

(65) Prior Publication Data

US 2007/0137720 A1 Jun. 21, 2007

(30) Foreign Application Priority Data

Dec. 16, 2005 (DE) ..... 10 2005 060 301

(51) Int. Cl.
*D21F 7/08* (2006.01)
*D03D 3/04* (2006.01)
*D03D 25/00* (2006.01)

(52) U.S. Cl. ..... 139/383 R; 139/383 AA; 162/348; 162/358.2

(58) Field of Classification Search ..... None
See application file for complete search history.

(56) References Cited

U.S. PATENT DOCUMENTS

| | | | | | |
|---|---|---|---|---|---|
| 4,041,989 | A * | 8/1977 | Johansson et al. | ..... | 139/425 A |
| 4,071,050 | A * | 1/1978 | Codorniu | ..... | 139/383 R |
| 4,564,051 | A * | 1/1986 | Odenthal | ..... | 139/425 A |
| 4,934,414 | A * | 6/1990 | Borel | ..... | 139/383 A |
| 5,092,372 | A * | 3/1992 | Fitzka et al. | ..... | 139/383 A |
| 5,151,316 | A * | 9/1992 | Durkin et al. | ..... | 428/213 |
| 5,152,326 | A * | 10/1992 | Vohringer | ..... | 139/383 A |
| 5,358,014 | A * | 10/1994 | Kovar | ..... | 139/383 A |
| 5,421,374 | A * | 6/1995 | Wright | ..... | 139/383 A |
| 5,465,764 | A * | 11/1995 | Eschmann et al. | ..... | 139/383 A |
| 5,826,627 | A | 10/1998 | Seabrook et al. | ..... | 139/383 |
| 6,202,705 | B1 * | 3/2001 | Johnson et al. | ..... | 139/383 A |
| 2003/0178087 | A1 * | 9/2003 | Odenthal | ..... | 139/383 A |

(Continued)

FOREIGN PATENT DOCUMENTS

| | | |
|---|---|---|
| EP | 1 294 981 | 3/2001 |

*Primary Examiner*—Bobby H Muromoto, Jr.
(74) *Attorney, Agent, or Firm*—Taylor & Aust, P.C.

(57) ABSTRACT

This invention relates to a paper machine covering such as a mesh, in particular forming mesh, having an upper fabric layer which is repeated in upper repeats and whose outer side forms the paper side of the mesh, having a lower fabric layer whose outer side forms the machine side of the mesh, and having tie threads arranged in groups and extending in the longitudinal thread direction, which connect the upper fabric layer and the lower fabric layer to each other, wherein the upper fabric layer is formed at least by the tie threads and, woven therewith, upper transverse threads extending transverse to the tie threads, in that the tie threads of each group alternate in sections when weaving with the upper transverse threads in the longitudinal thread direction, thus jointly creating an upper longitudinal thread run which is repeated over the length of the upper repeat in the longitudinal thread direction, wherein the lower fabric layer is formed at least by the tie threads and, woven therewith, lower transverse threads extending transverse to the tie threads, wherein the tie threads of each group cross when switching from weaving with the upper transverse threads to weaving with the lower transverse threads and vice versa, thus forming intersections. The tie threads of at least one group are woven with the upper and lower transverse threads such that at least two consecutive intersections are arranged over the length of the upper repeat in the longitudinal thread direction.

28 Claims, 3 Drawing Sheets

U.S. PATENT DOCUMENTS

2003/0217782 A1* 11/2003 Nagura et al. ..... 139/383 A
2004/0003860 A1* 1/2004 Taipale et al. ..... 139/383 A
2004/0020621 A1 2/2004 Heger et al. ..... 162/348
2004/0089363 A1* 5/2004 Josef et al. ..... 139/383 A
2006/0169346 A1 8/2006 Fahrer et al. ..... 139/383
2007/0028992 A1 2/2007 Westerkamp ..... 139/383

* cited by examiner

PAPER MACHINE COVERING

BACKGROUND OF THE INVENTION

1. Field of the Invention

This invention relates to a paper machine covering such as a mesh, in particular forming mesh.

2. Description of the Related Art

Requirements of many different types are imposed on paper machine meshes. For example, the paper side of the mesh facing the paper, in particular for the production of graphic papers, has to have a finely structured surface with the fewest possible marking points, the latter often being formed by so-called bonding diagonals. To achieve the longest possible life, on the other hand, the running side of the covering must have a rough structure with a large wearing volume in order to protect the force-absorbing fibers which are aligned in the machine direction.

To meet these requirements, coverings were developed in the past with a paper-side fabric and a running-side fabric, the two being connected together by way of tie threads.

From EP 1 294 981 there is known a forming mesh, for example, which has a paper-side fabric constructed as a linen bond and on which, in each running-side repeat in the warp direction, two intersections of the tie threads are formed when switching between their weaving with the paper-side and the running-side fabrics. In the case of the linen bond, the warp lifts are arranged on diagonals running parallel to each other, thus resulting in increased marking of the paper formed on such a fabric.

What is needed in the art is an improved paper machine covering such as a mesh with a reduced tendency to marking, on which the paper-side upper fabric layer and the running-side lower fabric layer are firmly connected to each other.

SUMMARY OF THE INVENTION

The present invention provides a paper machine covering such as a mesh, in particular a forming mesh, having an upper fabric layer which is repeated in upper repeats and whose outer side forms the paper side of the mesh. The mesh includes in addition a lower fabric layer, whose outer side forms the machine side of the mesh, and tie threads arranged in groups and extending in the longitudinal thread direction, which connect the upper fabric layer and the lower fabric layer to each other. On the paper machine mesh of the invention, the upper fabric layer is formed at least by the tie threads and, woven therewith, upper transverse threads extending transverse to the tie threads, in that the tie threads of each group alternate in sections when weaving with the upper transverse threads in the longitudinal thread direction, thus jointly creating an upper longitudinal thread run which is repeated over the length of the upper repeat in the longitudinal thread direction. Furthermore, the lower fabric layer of the paper machine is formed at least by the tie threads and, woven therewith, lower transverse threads extending transverse to the tie threads, wherein the tie threads of each group cross when switching from weaving with the upper transverse threads to weaving with the lower transverse threads and vice versa, thus forming intersections.

The tie threads of at least one group are woven with the upper and lower transverse threads such that at least two consecutive intersections are arranged over the length of the upper repeat in the longitudinal thread direction.

By providing at least two consecutive intersections per upper longitudinal thread repeat, a high tie frequency between the upper or paper-side fabric and the lower or running-side fabric is created, as the result of which a firm connection between the paper-side fabric and the running-side fabric is provided. On the other hand, by providing at least two consecutive intersections per upper longitudinal thread repeat it is possible, on account of a longer longitudinal thread repeat, meaning a longitudinal thread repeat formed with more upper transverse threads, to create a larger upper repeat with fewer longitudinal thread lifts regularly arranged in relation to each other than is the case with a linen bond, as the result of which the tendency to marking is significantly reduced. It is even possible to provide a completely irregular arrangement of the longitudinal thread lifts and lowerings in the upper repeat, as the result of which it is possible to create a paper-side fabric structure with nearly no tendency to marking because the paper side thus created has a pattern which is repeated only from paper-side repeat to paper-side repeat and not within a single paper-side repeat.

Furthermore, by providing at least two consecutive intersections per paper-side or upper longitudinal thread repeat the intersections can be distributed more irregularly than is possible with the meshes known from the prior art, as the result of which in particular the visibility of markings produced by different hydraulic dewatering pressure is reduced.

According to an embodiment of the present invention, the upper fabric layer is formed only by weaving the upper transverse threads with the tie threads. An advantage of this configuration is that it is possible, in particular for applications in which the covering is exposed to intensive flexing, to produce a paper machine mesh that guarantees a better connection between the upper fabric layer and the lower fabric layer.

Of course it is also possible for the upper fabric layer to be formed by weaving the grouped tie threads with the upper transverse threads and by weaving upper longitudinal threads with the upper transverse threads. In this case the upper longitudinal threads are woven only with upper transverse threads, which is why each upper longitudinal thread forms an upper longitudinal thread run when weaving with the upper transverse threads.

According to a further aspect of the invention, the upper fabric layer is irregular. If the upper fabric layer is formed by weaving the tie threads with the upper transverse threads, then each upper longitudinal thread run formed by a group of tie threads includes longitudinal thread lifts and longitudinal thread lowerings. A longitudinal thread lift is formed in this case in that the respective tie thread of a group, which is weaving with upper transverse threads, continually crosses an upper transverse thread on the outside of the upper fabric layer. A longitudinal thread lowering is formed in this case in that the respective tie thread of a group, which is weaving with upper transverse threads, continually crosses an upper transverse thread between the upper and lower fabric layer.

If the upper fabric layer is formed in addition by weaving upper longitudinal threads with the upper transverse threads, then longitudinal thread lifts are formed as the result in that the upper longitudinal thread continually crosses an upper transverse thread on the outside of the upper fabric layer. Also, longitudinal thread lowerings are formed in that the upper longitudinal thread continually crosses an upper transverse thread between the upper and lower fabric layer.

The upper fabric layer is irregularly constructed in this case in that, in the upper repeat, the arrangement of longitudinal thread lifts and lowerings on the outside forms an irregular pattern.

In concrete terms, the irregular pattern of the upper fabric layer can be formed in that, in the upper repeat, at least two longitudinal thread runs are constructed such that it is not possible for the one of the two longitudinal thread runs to be formed by offsetting all of its longitudinal thread lifts and lowerings by an identical number of upper transverse threads in the longitudinal thread direction from the other of the two longitudinal thread runs.

Because the upper repeat includes at least two longitudinal thread runs, with which it is not possible for the one of the two longitudinal thread runs to be created by offsetting all of its longitudinal thread lifts and lowerings by an identical number of upper transverse threads in the longitudinal thread direction from the other of the two longitudinal thread runs, then the number of bonding diagonals and regular structures on the paper side is reduced, thus leading to a reduction of the marking of paper produced with the paper machine mesh.

To obtain a nearly completely irregular paper side of the inventive mesh, another further aspect of the invention provides for the upper weaving pattern to have an irregular structure in that none of the upper longitudinal thread runs in the upper repeat can be produced by offsetting all of its longitudinal thread lifts and longitudinal thread lowerings by an identical number of upper transverse threads in the longitudinal thread direction from another upper longitudinal thread run of the repeat. Such bonds are referred to as crêpe bonds.

The upper fabric layer includes in this case upper transverse threads or upper transverse threads and tie threads, which have a diameter in the range from 0.03 mm to 0.5 mm, preferably 0.08 mm to 0.15 mm. A particularly fine and marking-free paper side can thus be produced.

According to another embodiment of the invention, provision can be made for the irregular pattern to be formed by the upper repeat having a first upper longitudinal thread run, a second longitudinal thread run directly adjacent thereto and a third longitudinal thread run directly adjacent to the second, which are constructed such that the offset of the longitudinal thread lifts and longitudinal thread lowerings of the second longitudinal thread run relative to the longitudinal thread lifts and lowerings of the first longitudinal thread run is not identical with the offset of the longitudinal thread lifts and longitudinal thread lowerings of the third longitudinal thread run relative to the longitudinal thread lifts and lowerings of the second longitudinal thread run.

According to another embodiment of the invention, the irregular paper-side weaving structure can also be provided in that the upper weaving structure includes a number of mutually different longitudinal thread runs, wherein the number of the mutually different longitudinal thread runs is smaller than the number of longitudinal thread runs forming the upper repeat.

On this embodiment, the mutually different longitudinal thread runs are arranged in a non-repeating sequence over the entire upper repeat. The longitudinal thread repeat thus produced can then be very large, including 12 longitudinal thread runs for example, wherein the number of mutually different longitudinal thread runs amounts to only four for example. This means that a bond with a very large repeat can be woven with only a very small number of shafts for the paper side. The sequence of the longitudinal thread runs can be for example:

1-2-3-1-4-1-2-3-4-2-3-1

Such a bond is also referred to as a crêpe bond.

The number of longitudinal thread lifts and longitudinal thread lowerings in the upper repeat is essentially identical. The paper side is thus dominated by neither longitudinal thread lifts nor longitudinal thread lowerings, resulting in an on the whole flat paper side with an irregular structure and therefore a further reduced tendency to marking.

To obtain a nearly completely irregular paper side of the inventive mesh, another further aspect of the invention provides for none of the upper longitudinal thread runs in the upper repeat to be producible by offsetting all of its longitudinal thread lifts and lowerings by an identical number of upper transverse threads in the longitudinal thread direction from another longitudinal thread run. This means that each longitudinal thread run in the upper repeat is different in its longitudinal thread lift and lowering sequence to the other longitudinal thread runs.

In terms of bonding technique, the irregular structure of the upper fabric layer can be formed, either alone or in combination, by free textile development, changing a basic textile bond, deriving a basic textile bond, extending a basic textile bond.

The tendency to marking can be further reduced if the paper-side repeat is large, meaning formed from at least 14 upper transverse threads. By enlarging the paper-side repeat it is possible, with an irregular arrangement of the longitudinal thread lifts in the paper-side repeat for example, to reduce the tendency to marking significantly because the distance between longitudinal thread lifts regularly arranged in relation to each other increases due to the enlargement of the repeat.

To produce a finely structured paper side it is advantageous for the previously mentioned upper longitudinal thread lowerings and longitudinal thread lifts to have relatively short floatings. Hence an embodiment of the invention provides, per upper longitudinal thread run, for a maximum of three, preferably a maximum of two paper-side longitudinal thread lifts to be arranged directly adjacent to each other and for a maximum of three, preferably a maximum of two paper-side longitudinal thread lowerings to be arranged directly adjacent to each other.

According to a further aspect of the invention, the ratio of upper to lower transverse threads is greater than 1, in particular 2:1 or 3:2. By providing a ratio of upper to lower transverse threads greater than 1 it is possible in particular to produce a covering which combines a fine, meaning non-marking paper side with a rough and wearing running side, on the one hand because the paper-side fabric is formed by more transverse threads than with a 1 to 1 ratio and on the other hand because for the running-side fabric it is possible to use running-side transverse threads with a larger thread diameter than with a 1 to 1 ratio.

A further aspect of the invention provides for each lower transverse thread to be held respectively by several tie threads in that each of these tie threads continually crosses the respective lower transverse thread on the outer side of the lower fabric layer, wherein some of the tie threads holding a respective lower transverse thread are separated from each other by at least one tie thread not holding the respective lower transverse thread in that the non-holding tie thread does not continually cross the respective lower transverse thread on the outer side of the lower fabric layer, and wherein provision is made for several lower transverse threads for which an identical number of non-holding tie threads is arranged respectively between consecutive tie threads holding the respective lower transverse thread.

On several of the lower transverse threads, an identical number of non-holding tie threads is always arranged between consecutive tie threads respectively holding the lower transverse thread, hence each of these transverse threads always has the same floating length on the outer side of the lower fabric, meaning on the machine side, of the paper machine mesh, between consecutive points at which said transverse thread is held by a tie thread, so-called tie points of the upper fabric to the lower fabric.

The identical floating lengths of the transverse threads between the tie points provides a uniformly distributed connection of the upper fabric layer to the lower fabric layer, thus providing a paper machine mesh with a significantly improved flatness of the machine side and paper side with regard to the prior art.

Owing to the uniform distribution of the tie points it is possible in addition to distribute the holding force uniformly, thus enabling a significantly stronger connection between the two fabric layers to be obtained, as the result of which their relative movement can be reduced to a minimum, which leads to a minimization of the inner wear of the paper machine mesh.

Furthermore, the uniform distribution of the tie points and the stronger connection of the upper fabric layer to the lower fabric layer thus made possible leads to a reduced overall thickness of the paper machine mesh compared to the meshes known from the prior art.

The identical floating lengths of the transverse threads between the tie points also produces a uniformly distributed wear volume of the lower transverse threads extending on the outer side of the lower fabric (machine side), which protect the load-bearing tie threads.

Hence it is possible that for one lower transverse thread the number of non-holding tie threads arranged between consecutive holding tie threads is five and for another lower transverse thread seven.

According to an embodiment of the invention based thereon, provision is made to arrange for each lower transverse thread between consecutive tie threads respectively holding the lower transverse thread an identical number of tie threads respectively not holding the transverse thread. Because all lower transverse threads always have an identical floating length both in respect of themselves and with regard to the other transverse threads, the uniformity of the tie points is further increased, thus intensifying the previously described positive effects on this embodiment.

Preferably the number of tie threads not holding the respective transverse thread amounts to between two and twenty, preferably between six and ten. Tests have shown that given identical lengths of between two and twenty, tie threads not holding the respective lower transverse thread can provide a good connection between the upper and lower fabric layer paired with an improved wear resistance, in particular for use in paper machines at speeds of 1500 m/min or more.

For greater flexibility in the construction of the upper and lower fabric layer of the inventive paper machine mesh, the complete repeat is formed by a multiplicity of longitudinal threads and/or upper and lower transverse threads. In concrete terms, the complete repeat of the paper machine mesh can include for example 24 or more, or 26 or more, or 32 or more, or 48 or more longitudinal thread runs and/or 24 or more, or 26 or more, or 32 or more, or 48 or more upper and lower transverse threads.

For example, the tendency to marking of the paper side can be significantly reduced by the upper fabric layer having an upper repeat which is formed by 24 or more longitudinal thread runs and by 24 or more upper transverse threads.

According to a concrete embodiment of the invention, the tie threads are warp threads and the transverse threads are weft threads. In this case the system is a warp-tied system. However, it is also possible for the tie threads to be weft threads and the transverse threads to be warp threads. In this case the system is a weft-tied system.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
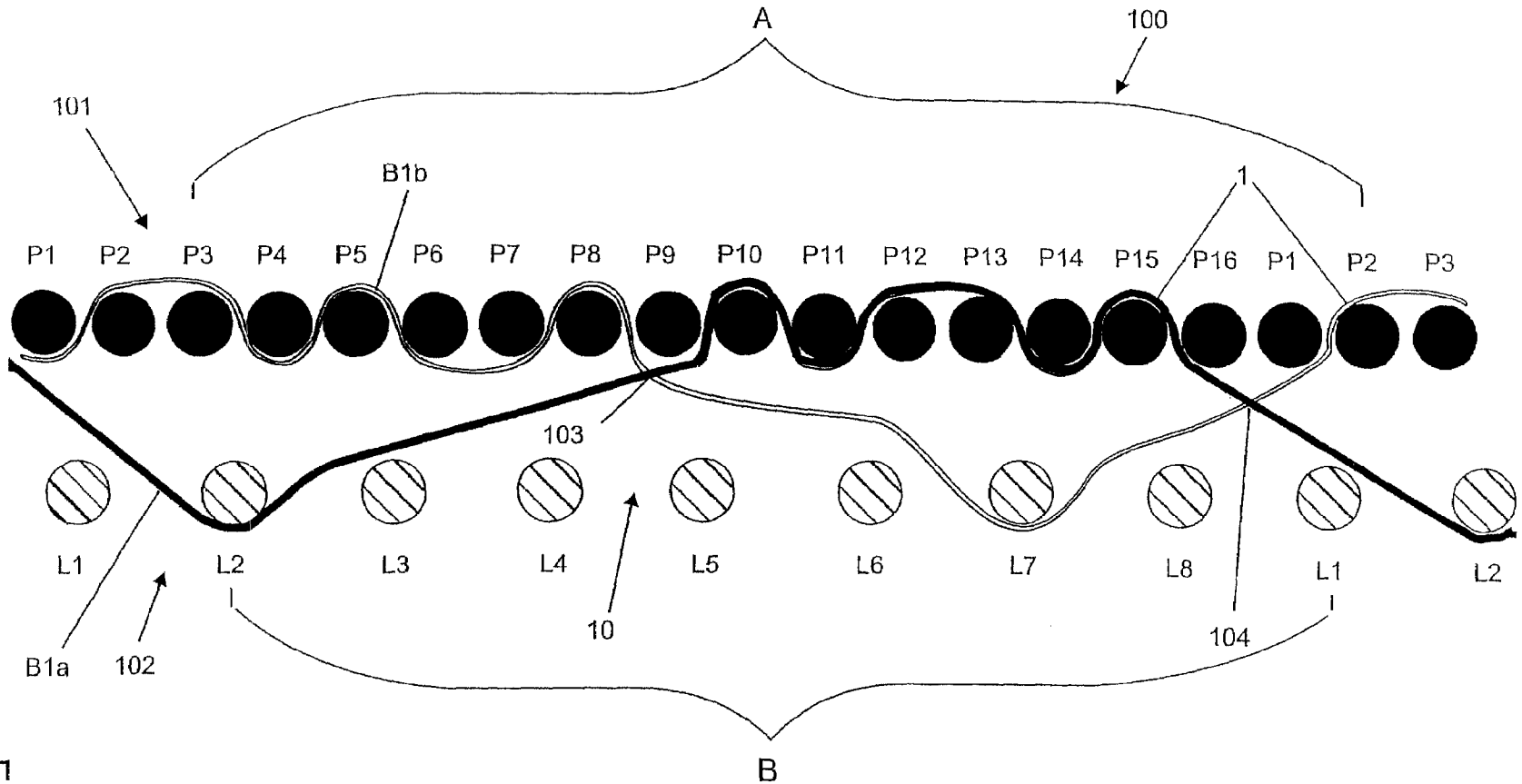
FIG. 1 shows the weaving paths of two longitudinal threads of a paper machine covering of the invention, which form a group.

Referring now to the drawings, and more particularly to FIG. 1, there is shown the run of two tie threads B1*a*, B1*b*, arranged side by side and forming a group, of a paper machine mesh constructed as a forming mesh. The two tie threads B1*a*, B1*b* are warp threads which are woven in sections alternately with upper or paper-side transverse threads P1 to P16, which are weft threads. During weaving with the paper-side transverse threads P1 to P16, the two tie threads B1*a*, B1*b* together form an upper or paper-side longitudinal thread run 1 which is repeated in paper-side longitudinal thread repeats A. The paper-side longitudinal thread repeat A is formed accordingly from 16 upper transverse threads. In addition, the two tie threads B1*a*, B1*b* are woven in sections alternately with lower or running-side transverse threads L1 to L8, which likewise are weft threads, and during weaving with the running-side transverse threads L1 to L8 together form a running-side longitudinal thread run 10 which is repeated in running-side longitudinal thread repeats B. The lower or running-side longitudinal thread repeat B is formed accordingly from eight running-side transverse threads. Weaving the two tie threads B1*a*, B1*b* with the paper-side transverse threads P1 to P16 and with the running-side transverse threads L1 to L8 means on the one hand that the paper-side fabric 101 is connected to the running-side fabric 102 and on the other hand that the paper-side fabric 101 and the running-side fabric 102 are formed.

As is evident from FIG. 1, the ratio of paper-side transverse threads P1 to P16 to running-side transverse threads L1 to L8 is 2:1.

During switching of the tie threads B1*a*, B1*b* from weaving with the paper-side transverse threads P1 to P16 to weaving with the running-side transverse threads L1 to L8 and vice versa, the tie threads B1*a*, B1*b* of the group cross, thus forming intersections 103 and 104.

According to the invention, the two tie threads B1*a*, B1*b* forming a group are woven with the paper-side transverse threads P1 to P16 and with the running-side transverse threads L1 to L8 such that at least two consecutive intersections 103 and 104 are arranged within a paper-side longitudinal thread repeat A.

In addition, the tie threads B1*a*, B1*b* are woven with the paper-side transverse threads P1 to P16 and with the running-side transverse threads L1 to L8 such that two consecutive intersections 103 and 104 are arranged within each running-side longitudinal thread repeat B.

On the embodiment of the inventive paper machine covering 100 presented in FIG. 1, the paper-side fabric 101 is formed by weaving the paper-side transverse threads P1 to P16 with the tie threads (this becomes evident later from FIGS. 2 and 3). In addition, the running-side fabric 102 is formed by weaving the running-side transverse threads L1 to L8 with the tie threads (this becomes evident later from FIG. 3).

Figure 2:
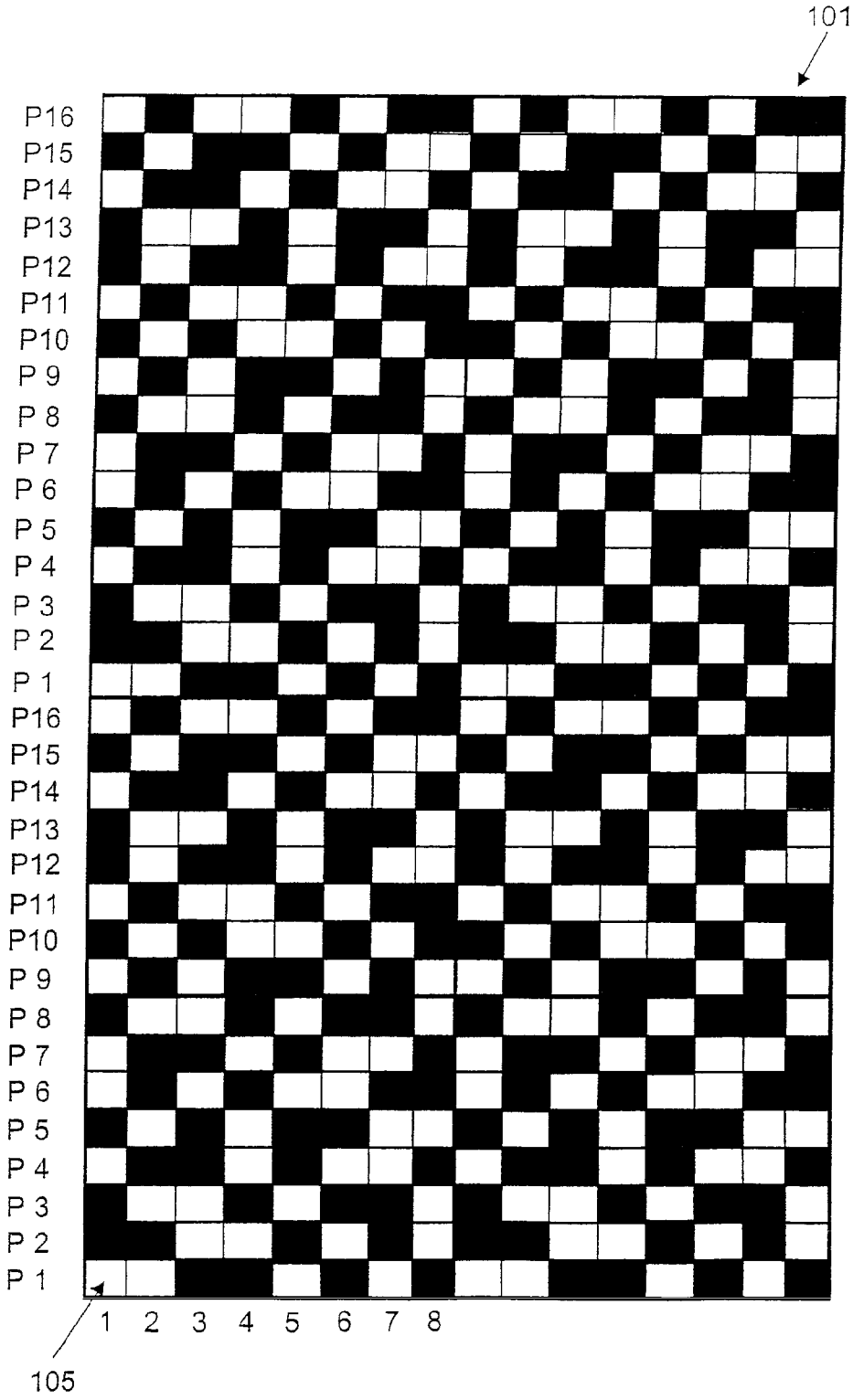
FIG. 2 shows a schematic representation of paper-side longitudinal thread lifts in a plan view of the paper side from FIG. 1.

FIG. 2 shows a schematic representation of paper-side longitudinal thread lifts (dark squares) and paper-side longitudinal lowerings (bright squares) in a plan view of the paper-side fabric 101 from FIG. 1, which are formed during weaving of the tie threads grouped in pairs with the paper-side transverse threads P1 to P16. For example, the two tie threads B1*a*, B1*b* weave along the longitudinal thread run 1 over the paper-side transverse threads P2, P3, P5, P8, P10, P12, P13 and P15, thus forming paper-side longitudinal thread lifts, and under the paper-side transverse threads P1, P4, P6, P7, P9, P11, P14 and P16, thus forming paper-side longitudinal thread lowerings (see also FIG. 1).

The paper-side fabric 101 is formed by repeating paper-side repeats 105, which are formed respectively by longitudinal thread runs 1 to 8 when weaving over and under the paper-side transverse threads P1 to P16. FIG. 2 thus represents four paper-side repeats arranged side by side.

As is evident from FIG. 2, the arrangement of the paper-side longitudinal thread lifts within the paper-side repeat 105 is such that an irregular pattern is formed. In this connection an irregular pattern is understood to be a pattern on which not all the longitudinal thread lifts in repeat 105 can be developed from one of the longitudinal thread runs by a single regularity. An example of such an irregular pattern is, for example, a pattern on which at least two longitudinal thread runs are constructed such that it is not possible for the one of the two longitudinal thread runs to be formed by offsetting all of its longitudinal thread lifts and lowerings by an identical number of upper transverse threads in the longitudinal thread direction from the other of the two longitudinal thread runs.

In the example in FIG. 2, the irregular pattern in repeat 105 is formed in that none of the upper longitudinal thread runs 1 to 8 can be produced by offsetting all of its longitudinal thread lifts and lowerings by an identical number of upper transverse threads P1 to P16 in the longitudinal thread direction from another longitudinal thread run. For example, the upper longitudinal thread run 1 cannot be produced from any of the longitudinal thread runs 2 to 8 by offsetting all of its longitudinal thread lifts and lowerings by an identical number of upper transverse threads P1 to P16 in the longitudinal thread direction.

To obtain as fine a structure as possible for the paper-side fabric 101, each paper-side longitudinal thread run 1 to 8 in the paper-side repeat 105 is formed by a maximum of two paper-side longitudinal thread lifts arranged directly adjacent to each other and by a maximum of two paper-side longitudinal thread lowerings arranged directly adjacent to each other.

Figure 3:
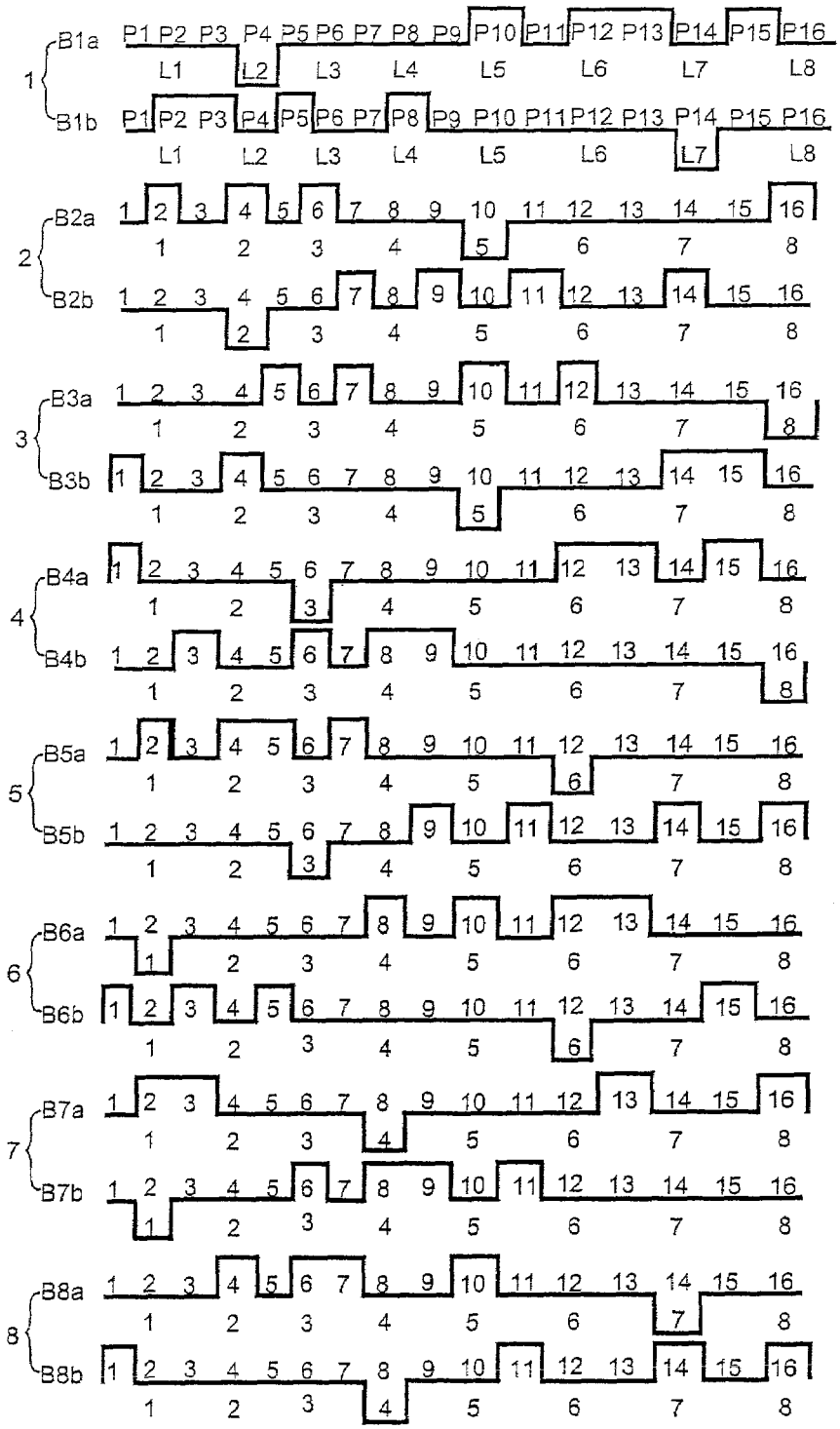
FIG. 3 shows the weaving paths of all the longitudinal threads of a repeat of the paper machine covering of the invention from FIG. 1.

FIG. 3 shows the weaving paths of all the tie threads B1*a*, B1*b*, B2*a*, B2*b* . . . to B8*a*, B8*b* of the repeat of the inventive paper machine covering 101 from FIG. 1. As is evident, the longitudinal thread pairs B1*a*, B1*b* and B2*a*, B2*b* and B3*a*, B3*b* to B8*a*, B8*b* respectively form, when weaving with the paper-side transverse threads P1 to P16, the longitudinal thread runs 1 and 2 and 3 to 8 known from FIG. 2. For the sake of clarity, no running-side longitudinal thread runs formed during weaving of the longitudinal thread pairs B1*a*, B1*b* and B2*a*, B2*b* and B3*a*, B3*b* to B8*a*, B8*b* with the running-side transverse threads L1 to L8 are identified.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine covering comprising:

an upper fabric layer comprising a plurality of upper repeats and an upper fabric layer outer side, said upper fabric layer repeated in said plurality of upper repeats, said upper fabric layer outer side forming a paper side of the covering;

a lower fabric layer comprising a lower fabric layer outer side forming a machine side of the covering; and a plurality of tie threads arranged in a plurality of groups and extending in a longitudinal thread direction, said plurality of tie threads connecting said upper fabric layer and said lower fabric layer to each other, said upper fabric layer comprising at least said plurality of tie threads and, woven therewith, a plurality of upper transverse threads extending transverse to said plurality of tie threads, said plurality of tie threads of each of said plurality of groups alternating in a plurality of sections when weaving with said plurality of upper transverse threads in said longitudinal thread direction so as to respectively form a plurality of upper longitudinal thread runs, each of said plurality of longitudinal thread runs repeated over a length of each of said plurality of upper repeats in said longitudinal thread direction, said lower fabric layer comprising at least said plurality of tie threads and, woven therewith, a plurality of lower transverse threads extending transverse to said plurality of tie threads, said plurality of tie threads of each said plurality of groups comprising a plurality of intersections which includes said plurality of tie threads of each said plurality of groups crossing when switching from weaving with said plurality of upper transverse threads to weaving with said plurality of lower transverse threads and vice versa, said plurality of tie threads of at least one of said plurality of groups being woven with said plurality of upper transverse threads and said plurality of lower transverse threads such that at least two consecutive said plurality of intersections are arranged over said length of each of said plurality of upper repeats in said longitudinal thread direction, said upper fabric layer, said lower fabric layer, and said plurality of tie threads together forming a repeating pattern of the paper machine covering, said plurality of tie threads forming only one upper fabric layer tie thread repeat within said repeating pattern.

2. The paper machine covering according to claim 1, wherein said upper fabric layer comprises weaving said plurality of upper transverse threads with said plurality of tie threads.

3. The paper machine covering according to claim 1, further comprising a plurality of upper longitudinal threads, wherein said upper fabric layer comprises weaving said plurality of upper transverse threads with said plurality of tie threads and with said plurality of upper longitudinal threads.

4. The paper machine covering according to claim 1, further comprising a plurality of longitudinal threads, wherein said lower fabric layer comprises weaving said plurality of lower transverse threads with said plurality of longitudinal threads.

5. The paper machine covering according to claim 1, further comprising a plurality of longitudinal threads and a plurality of lower longitudinal threads, wherein said lower fabric layer comprises weaving said plurality of lower transverse threads with said plurality of longitudinal threads and said plurality of lower longitudinal threads.

6. The paper machine covering according to claim 1, wherein said plurality of upper transverse threads to said plurality of lower transverse threads comprises a ratio which is greater than 1.

7. The paper machine covering according to claim 1, wherein said plurality of upper transverse threads to said plurality of lower transverse threads comprises a ratio which is 2:1.

8. The paper machine covering according to claim 1, wherein said plurality of upper transverse threads to said plurality of lower transverse threads comprises a ratio which is 3:2.

9. The paper machine covering according to claim 1, wherein each of said plurality of upper longitudinal thread runs formed respectively by each of said plurality groups of said plurality of tie threads comprises a plurality of tie thread lifts and a plurality of tie thread lowerings, wherein each of said plurality of tie thread lifts comprises a respective one of said plurality of tie threads of a respective one of said plurality of groups, which is weaving with said plurality of upper transverse threads, continually crossing at least one of said plurality of upper transverse threads on said outer side of said upper fabric layer, wherein each of said plurality of tie thread lowerings comprises a respective one of said plurality of tie threads of a respective one of said plurality of groups, which is weaving with said plurality of upper transverse threads, continually crossing at least one of said plurality of upper transverse threads between said upper fabric layer and said lower fabric layer, and wherein said plurality of tie thread lifts and said plurality of tie thread lowerings in each of said plurality of upper repeats comprises an arrangement including an irregular pattern.

10. The paper machine covering according to claim 9, wherein said plurality of upper longitudinal thread runs includes a plurality of longitudinal thread lifts and a plurality of longitudinal thread lowerings, wherein said irregular pattern comprises, in each of said plurality of upper repeats, at least two of said plurality of upper longitudinal thread runs, said at least two of said plurality of upper longitudinal thread runs including a first upper longitudinal thread run and a second upper longitudinal thread run, wherein said first upper longitudinal thread run cannot be formed by offsetting all of said plurality of longitudinal thread lifts and longitudinal thread lowerings of said first upper longitudinal thread run by an identical number of said plurality of upper transverse threads in said longitudinal thread direction from said second upper longitudinal thread run.

11. The paper machine covering according to claim 10, wherein none of said plurality of upper longitudinal thread runs in each of said plurality of upper repeats can be produced by offsetting all of said plurality of tie thread lifts and tie thread lowerings of respective said plurality of upper longitudinal thread runs by an identical number of said plurality of upper transverse threads in said longitudinal thread direction from another of said plurality of upper longitudinal thread runs.

12. The paper machine covering according to claim 11, wherein said plurality of upper longitudinal thread runs comprise a first upper longitudinal thread run, a second upper longitudinal thread run, and a third upper longitudinal thread run, wherein said irregular pattern is formed by each of said plurality of upper repeats having said first upper longitudinal thread run, said second longitudinal thread run directly adjacent thereto, and said third longitudinal thread run directly adjacent to said second upper longitudinal thread run, wherein said plurality of longitudinal thread lifts and longitudinal thread lowerings of said second upper longitudinal thread run relative to said plurality of longitudinal thread lifts and longitudinal thread lowerings of said first upper longitudinal thread run comprises a first offset, wherein said plurality of longitudinal thread lifts and longitudinal thread lowerings of said third upper longitudinal thread run relative to said plurality of longitudinal thread lifts and longitudinal thread lowerings of said second upper longitudinal thread run comprises a second offset, said first offset being not identical with said second offset.

13. The paper machine covering according to claim 12, wherein a number of said plurality of longitudinal thread lifts and said plurality of longitudinal thread lowerings in each of said plurality of upper repeats is essentially identical.

14. The paper machine covering according to claim 12, wherein the paper machine includes an upper weaving pattern having an irregular structure, said irregular structure of said upper weaving pattern formed, one of alone and in combination, at least one of by a free textile development, changing a basic textile bond, deriving a basic textile bond, and extending a basic textile bond.

15. The paper machine covering according to claim 9, further comprising a plurality of upper longitudinal thread lifts and a plurality of upper longitudinal thread lowerings, wherein in each case a maximum of two of said plurality of upper longitudinal thread lifts and a maximum of two of said plurality of upper longitudinal thread lowerings are arranged directly adjacent to each other.

16. The paper machine covering according to claim 1, wherein each of said plurality of lower transverse threads is held respectively by several of said plurality of tie threads in that each of said several of said plurality of tie threads continually crosses respective said plurality of lower transverse thread on said outer side of said lower fabric layer, wherein some of said plurality of tie threads holding respective said plurality of lower transverse threads are separated from each other by at least one of said plurality of tie threads not holding respective said plurality of lower transverse threads in that said at least one of said plurality of tie threads not holding respective said plurality of lower transverse threads does not continually cross respective said plurality of lower transverse threads on said outer side of said lower fabric layer, and wherein several of said plurality of lower transverse threads include an identical number of said at least one of said plurality of tie threads not holding respective said plurality of lower transverse threads arranged respectively between consecutive said plurality of tie threads holding respective said plurality of lower transverse threads.

17. The paper machine covering according to claim 16, wherein for each of said plurality of lower transverse threads between consecutive said plurality of tie threads holding respective said plurality of lower transverse threads there is always arranged an identical number of said at least one of plurality of tie threads not holding respective said plurality of lower transverse threads.

18. The paper machine covering according to claim 16, wherein a number of said at least one of said plurality of tie threads not holding respective said plurality of lower transverse threads amounts to between two and twenty.

19. The paper machine covering according to claim 16, wherein a number of said at least one of said plurality of tie threads not holding respective said plurality of lower transverse threads amounts to between six and ten.

20. The paper machine covering according to claim 1, wherein each of said plurality of upper repeats of said upper fabric layer comprises at least 14 of said plurality of upper transverse threads.

21. The paper machine covering according to claim 1, wherein said lower fabric layer comprises a repeat including at least seven of said plurality of lower transverse threads.

22. The paper machine covering according to claim 1, wherein said plurality of tie threads comprise seven of said plurality groups, each of said plurality of groups including of two of said plurality of tie threads.

23. The paper machine covering according to claim 1, further comprising a plurality of longitudinal threads, wherein at least 24 of at least one of said plurality of longitudinal threads and said plurality of upper and said plurality of lower transverse threads comprise a complete repeat of the paper machine covering.

24. The paper machine covering according to claim 1, further comprising a plurality of longitudinal threads, wherein at least 26 of at least one of said plurality of longitudinal threads and said plurality of upper and said plurality of lower transverse threads comprise a complete repeat of the paper machine covering.

25. The paper machine covering according to claim 1, further comprising a plurality of longitudinal threads, wherein at least 32 of at least one of said plurality of longitudinal threads and said plurality of upper and said plurality of lower transverse threads comprise a complete repeat of the paper machine covering.

26. The paper machine covering according to claim 1, further comprising a plurality of longitudinal threads, wherein at least 48 of at least one of said plurality of longitudinal threads and said plurality of upper and said plurality of lower transverse threads comprise a complete repeat of the paper machine covering.

27. The paper machine covering according to claim 1, wherein said plurality of upper transverse threads and said plurality of lower transverse threads comprise a plurality of transverse threads, said plurality of tie threads being a plurality of warp threads and said plurality of transverse threads being a plurality of weft threads.

28. The paper machine covering according to claim 1, wherein said plurality of upper transverse threads and said plurality of lower transverse threads comprise a plurality of transverse threads, said plurality of tie threads being a plurality of weft threads and said plurality of transverse threads being a plurality of warp threads.

* * * * *